US007628344B2

(12) United States Patent
Mahakul et al.

(10) Patent No.: US 7,628,344 B2
(45) Date of Patent: Dec. 8, 2009

(54) FUEL INJECTOR WITH VOP LOSS RESISTANT VALVE SPRING FOR EMISSIONS-COMPLIANT ENGINE APPLICATIONS

(75) Inventors: Budhadeb Mahakul, Naperville, IL (US); Brent J. Valesano, Des Plaines, IL (US); Gary L. Cowden, Lowell, MI (US); Mike Smith, Comstock Park, MI (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 11/236,237

(22) Filed: Sep. 27, 2005

(65) Prior Publication Data

US 2006/0071099 A1 Apr. 6, 2006

Related U.S. Application Data

(60) Provisional application No. 60/613,774, filed on Sep. 28, 2004.

(51) Int. Cl.
*F02M 61/20* (2006.01)

(52) U.S. Cl. ..... 239/533.9; 239/533.2; 239/88; 239/90; 267/166; 267/167; 123/508

(58) Field of Classification Search ..... 239/533.2, 239/88, 90, 91, 92, 585.1, 533.9; 267/167, 267/180, 166; 123/508
See application file for complete search history.

(56) References Cited

U.S. PATENT DOCUMENTS

| | | | | | |
|---|---|---|---|---|---|
| 2,026,007 | A | * | 12/1935 | White | 267/166 |
| 2,260,606 | A | * | 10/1941 | Clark | 267/166 |
| 4,550,875 | A | * | 11/1985 | Teerman et al. | 239/88 |
| 4,572,433 | A | * | 2/1986 | Deckard | 239/88 |
| 5,010,783 | A | * | 4/1991 | Sparks et al. | 74/527 |
| 6,145,762 | A | * | 11/2000 | Orloff et al. | 239/533.2 |
| 6,209,798 | B1 | * | 4/2001 | Martin et al. | 239/88 |

FOREIGN PATENT DOCUMENTS

JP 2006-52827 * 2/2006

* cited by examiner

*Primary Examiner*—Dinh Q Nguyen
(74) *Attorney, Agent, or Firm*—Eugene M. Cummings, P.C.

(57) ABSTRACT

A fuel injector assembly for an emissions-based EMD 710 locomotive dieselengine. The fuel injector assembly includes a needle slidably positioned within a bore of a valve body of the injector assembly, where fuel pressure introduced into a bore chamber causes the needle to open a spray tip. A spring mounted within the bore forces the needle to close the spray tip when the fuel is not being applied. The spring is a dead coil spring including inactive coils where at least portions of the coils at both ends of the spring are in intimate contact with each other so as to reduce spring wear during operation of the assembly. Because the dead coil spring has reduced wear, the VOP set point of the fuel injector assembly can be reduced, which reduces NOx emissions.

22 Claims, 1 Drawing Sheet

FUEL INJECTOR WITH VOP LOSS RESISTANT VALVE SPRING FOR EMISSIONS-COMPLIANT ENGINE APPLICATIONS

CROSS REFERENCE TO RELATED APPLICATION

This application claims the benefit of U.S. Provisional Application No. 60/613,774, filed Sep. 28, 2004, titled "Fuel Injector with VOP Loss Resistant Valve Spring for Emissions-Compliant Engine Applications."

BACKGROUND OF THE INVENTION

1. Field of the Invention

This invention relates generally to a fuel injector for an engine and, more particularly, to a fuel injector for a locomotive diesel engine, where the fuel injector employs a dead coil spring to reduce spring wear and reduce combustion emissions.

2. Discussion of the Related Art

Certain engines, such as the EMD 710 locomotive diesel engine, employ fuel injectors that inject a controlled amount of fuel into the cylinders of the engine. FIG. 1 is a representative example of a fuel injector assembly 10 used for this purpose. The assembly 10 is mounted to a cylinder head 14, such as a cylinder head for a diesel engine. The assembly 10 includes a fuel injector 12 positioned within the cylinder head 14 so that a spray tip 16 of the fuel injector 12 extends into an engine cylinder (not shown). Each cylinder of the several cylinders in the engine would include such a fuel injector assembly. The fuel injector 12 is secured to the cylinder head 14 by a clamp 18. A rocker arm 20 in combination with a spring 22 mounted on a shaft 24 controls the fuel injected into the cylinder in a manner that is well understood in the art.

Known fuel injectors employ a valve needle slidably positioned within a nozzle body of the fuel injector 12. A spring biases the needle to close the spray tip 16 and fuel pressure from the fuel applied to the fuel injector 12 moves the needle against the bias of the spring to inject the fuel into the cylinder through the spray tip 16. The fuel pressure required to move the needle is determined by the geometry of the needle and the force generated by the spring. This pressure is referred to as the valve opening pressure (VOP).

The standard spring used in a fuel injector for this purpose has a high wear rate at the end coils of the spring as a result of the repetitive opening and closing of the spray tip 16. Particularly, tangs at the ends of the spring wear into a first adjacent coil of the spring. This spring wear results in significant VOP loss over time, and decreases the spring force and reduces the ability of the spring to close the spray tip 16.

After a certain amount of spring wear, combustion gases from the cylinder can blow back into the nozzle body and throughout the internal passageways of the injector, which leads to various emissions from the fuel injector 12, such as smoke and/or mechanical failure. Also, a reduction in the spring force may prevent the needle from completing closing the spray tip 16, which results in fuel dripping into the cylinder that causes injector "gum up." Further, because of the wear over the life of the spring, the fuel injector 12 requires a high VOP set point to offset the high VOP loss over time. This higher VOP set point produces higher levels of NOx emissions, which are detrimental to the environment. The higher NOx emissions makes it more difficult to meet U.S. EPA Tier 1 locomotive emission standards.

SUMMARY OF THE INVENTION

In accordance with the teachings of the present invention, a fuel injector assembly for an engine is disclosed, such as the emissions-based EMD 710 locomotive diesel engine. The fuel injector assembly includes a valve needle that is slidably positioned within a bore of a valve body of the injector assembly, where fuel pressure introduced into a bore chamber causes the needle to open a spray tip. A spring mounted within the bore biases the needle to close the spray tip when the fuel is not being applied. The spring is a dead coil spring including inactive coils, where at least portions of the coils at both ends of the spring are in intimate contact with each other so as to reduce spring wear during operation of the assembly. Because the dead coil spring has less wear, the VOP set point of the fuel injector assembly can be reduced, which reduces NOx emissions. Further, the reduced spring wear maintains the desired spring force longer for closing the spray tip of the fuel injector assembly, which reduces blow back from the cylinder into the fuel injector assembly.

Additional advantages and features of the present invention will become apparent from the following description and appended claims, taken in conjunction with the accompanying drawings.

DETAILED DESCRIPTION OF THE EMBODIMENTS

The following discussion of the embodiments of the invention directed to a fuel injector assembly for an engine is merely exemplary in nature, and is in no way intended to limit the invention or its applications or uses. For example, the fuel injector assembly is described herein as having particular application for an EMD 710 locomotive diesel engine. However, the fuel injector assembly of the invention has application for other types of engines.

Figure 1:
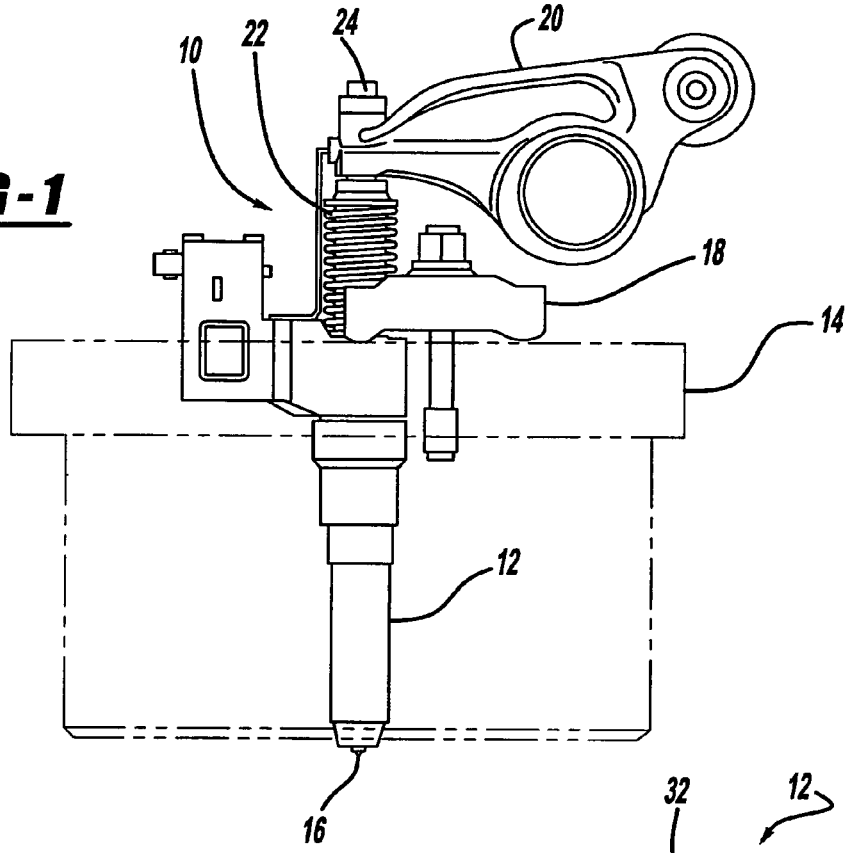
FIG. 1 is a plan view of a fuel injector assembly mounted to an engine block.
Figure 2:
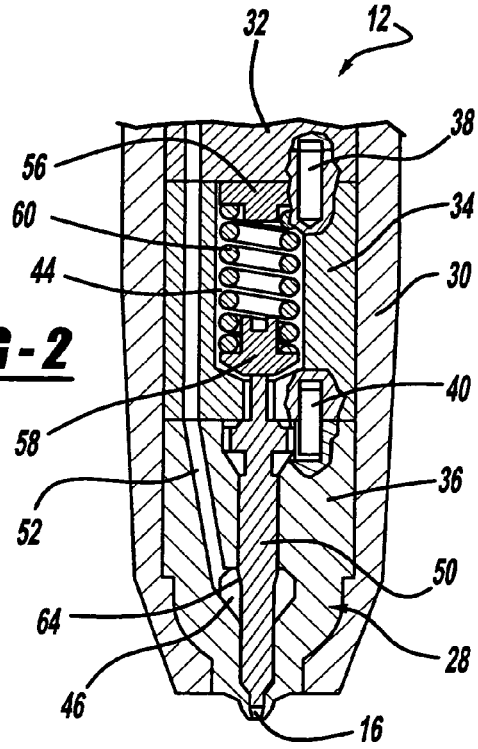
FIG. 2 is a cross-sectional view of an end of a fuel injector assembly employing a dead coil spring, according to an embodiment of the present invention.

FIG. 2 is a cross-sectional view of an end portion of the fuel injector 12. The fuel injector 12 includes an outer housing 30 and a valve body 28 having blocks 32, 34 and 36 positioned within the outer housing 30 that are aligned by alignment pins 38 and 40. The valve body 28 defines an internal bore 44 including a fuel injection chamber 46. A valve needle 50 is slidably positioned within the bore 44 and opens and closes the spray tip 16 that extends into the cylinder. A fuel channel 52 extends through the blocks 32, 34 and 36, and is also in fluid communication with the fuel chamber 46. A spring shim 56 is positioned at one end of the bore 44 and a spring seat 58 is mounted to an end of the needle 50 opposite to the tip 16. The spring shim 56 and the spring seat 58 position a dead coil spring 60 within the bore 44, which will be discussed in detail below.

As discussed above, the spring 60 applies a bias to the needle 50 to close the spray tip 16 when no fuel is being applied to the cylinder. When fuel under pressure is applied to the fuel channel 52 and enters the fuel chamber 46, it pushes against an angled surface 64 of the needle 50 and against the bias of the spring 60 to open the spray tip 16 of the fuel injector assembly 12 to control the fuel injected into the cylinder.

According to the invention, the spring 60 is a dead coil spring having inactive coils to reduce the wear on the spring coils so that a lower VOP set point can be used, which reduces NOx emissions. Also, the reduced wear on the spring 60 maintains the spring force longer over the life of the spring, which reduces blow back into the channel 52, which reduces other emissions from the fuel injector assembly 12, such as smoke.

Figure 3:
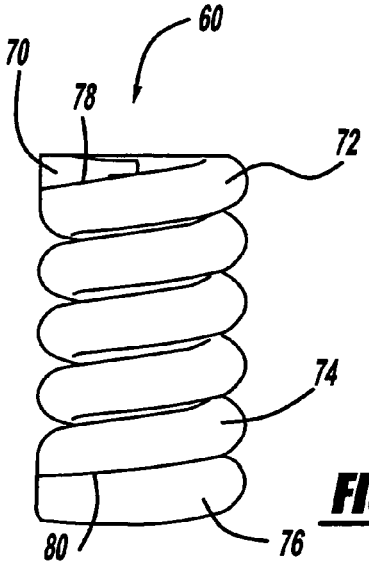
FIG. 3 is a perspective view of the dead coil spring removed from the fuel injector assembly shown in FIG. 2.

FIG. 3 is a perspective view of the spring 60 removed from the fuel injector 12. The spring 60 includes two top coils 70 and 72 positioned adjacent to the spring shim 56 and two bottom coils 74 and 76 positioned adjacent to the spring seat 58. The spring 60 is a dead coil spring because at least a portion of the coils 70 and 72 are in intimate contact with each other along a contact area 78, and at least a portion of the coils 74 and 76 are in intimate contact with each other along a contact area 80. Particularly, when the spring 60 is wound and heat treated, the coils 70 and 72 touch each other and the coils 74 and 76 touch each other, so that when the spring 60 expands and contracts, the coils 70 and 72 do not move relative to each other and the coils 74 and 76 do not move relative to each other. Because the coils 70 and 72 do not move relative to each other and the coils 74 and 76 do not move relative to each other, the load on the spring 60 is distributed along the contact areas 78 and 80, which reduces spring wear.

In this embodiment, the first two coils at the ends of the spring 60 are in intimate contact to provide the dead coil spring. However, other designs may allow for more than two coils to be in intimate contact.

In one embodiment, the fuel injector 12 is a unit fuel injector used in an EMD 710 locomotive diesel engine. In this embodiment, the spring 60 has 7.9 coils, where the number of active coils is 5.1 and the number of inactive coils at each end is about 1.4. The outer diameter of the spring 60 is 10.37 mm and the wire gage is 2.7 mm. Further, the overall length of the spring 60 is about 24.34 mm.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A fuel injector assembly comprising:

a nozzle body including a chamber therein and an opening in fluid communication with the chamber;

a fuel channel in fluid communication with the chamber;

a valve needle positioned in the chamber and being operable to open and close the opening; and a dead spring including a first end and a second end, said dead spring having at least two of its coils being at all times at least partially in continuous, intimate contact with each other in its natural state, said dead spring being positioned in the chamber and being in contact with the valve needle, said dead spring being operable to provide a force against the valve needle to close the opening an wherein said at least two coils of the dead spring in partial continuous, intimate contact are at all times at least partially in continuous, intimate contact with each other during compression and expansion of said dead spring; wherein fuel is supplied at a select valve opening pressure (VOP) against the force of the dead spring to open the valve needle, and wherein the dead spring is sized and shaped to reduce wear of the dead spring over time thereby lowering the valve opening pressure and limiting blow back into the fuel channel in order to reduce NOx emissions.

2. The fuel injector assembly according to claim 1 wherein the dead coil spring includes more than one coil in intimate contact with each other at the first end of the spring and more than one coil in intimate contact with each other at the second end of the spring.

3. The fuel injector assembly according to claim 2 wherein the number of coils in intimate contact with each other at the first and second ends of the springs is about 1.4 coils.

4. The fuel injector assembly according to claim 1 wherein the spring is about 24.34 mm in length and has an outer diameter of about 10.37 mm.

5. The fuel injector assembly according to claim 1 wherein the spring has about 7.9 coils, where the number of active coils is 5.1 and the number of inactive coils at the first and second ends of the spring is about 1.4.

6. The fuel injector assembly according to claim 1 wherein the fuel injector assembly is a unit fuel injector assembly.

7. The fuel injector assembly according to claim 1 wherein the fuel injector assembly is part of a diesel engine.

8. The fuel injector assembly according to claim 7 wherein the fuel injector assembly is part of an EMD 710 locomotive diesel engine.

9. A fuel injector assembly comprising:

a nozzle body including an internal bore and a spray tip in fluid communication with the internal bore;

a fuel chamber in fluid communication with the bore;

a fuel channel in fluid communication with the fuel chamber;

a valve needle positioned within the bore and extending through the chamber, and being operable to open and close the spray tip; and a dead coil spring including a first end and a second end, said dead coil spring having at least two of its coils being at all times at least partially in continuous, intimate contact with each other in its natural state, said dead coil spring being positioned within the bore in contact with the valve needle, said dead coil spring being operable to provide a force against the valve needle to close the spray tip and fuel pressure in the fuel chamber being operable to move the valve needle against the bias of the dead coil spring to open the spray tip, said dead coil spring including more than one coil at the first end of the dead coil spring in continuous, intimate contact with each other and more than one coil at the second end of the dead coil spring are in continuous, intimate contact with each other in situ during compression and expansion of said dead coil spring; wherein fuel is supplied at a select valve opening pressure (VOP) against the force of the dead spring to open the valve needle, and wherein the dead spring is sized and shaped to maintain a valve opening pressure and limit blow back into the fuel channel for achieving desired NOx emissions levels.

10. The fuel injector assembly according to claim 9 wherein the number of coils in intimate contact with each other at the first and second ends of the springs is about 1.4 coils.

11. The fuel injector assembly according to claim 9 wherein the spring is about 24.34 mm in length and has an outer diameter of about 10.37 mm.

12. The fuel injector assembly according to claim 9 wherein the spring has about 7.9 coils, where the number of active coils is 5.1 and the number of inactive coils at the first and second ends of the spring is about 1.4.

13. The fuel injector assembly according to claim 9 wherein the fuel injector assembly is a unit fuel injector assembly.

14. The fuel injector assembly according to claim 9 wherein the fuel injector assembly is part of a diesel engine.

15. The fuel injector assembly according to claim 14 wherein the fuel injector assembly is part of an EMD 710 locomotive diesel engine.

16. A fuel injector assembly for an EMD 710 locomotive diesel engine, said assembly comprising:

a nozzle body including an internal bore and a spray tip in fluid communication with the internal bore;

a fuel chamber in fluid communication with the bore;

a fuel channel in fluid communication with the fuel chamber;

a valve needle positioned within the bore and extending through the chamber, and being operable to open and close the spray tip; and a dead coil spring including a first end and a second end, said dead coil spring having at least two of its coils being at all times at least partially in continuous, intimate contact with each other in its natural state, said dead coil spring being positioned within the bore in contact with the valve needle, said dead coil spring being operable to provide a force against the needle to close the spray tip and fuel pressure in the fuel chamber being operable to move the needle against the force against of the dead coil spring to open the spray tip, said dead coil spring including more than one coil at the first end of the dead coil spring in continuous, intimate contact with each other and more than one coil at the second end of the dead coil spring in continuous, intimate contact with each other in situ during compression and expansion of said dead coil spring, wherein the dead coil spring has about 7.9 coils, where the number of active coils is 5.1 and the number of inactive coils at the first and second ends of the dead coil spring is about 1.4 to maintain a valve opening pressure and limit blow back into the fuel channel for achieving desired NOx emissions levels.

17. The fuel injector assembly according to claim 16 wherein the spring is about 24.34 mm in length and has an outer diameter of about 10.37 mm.

18. A dead spring for a fuel injector assembly comprising a nozzle body including a chamber therein and an opening in fluid communication with the chamber, a fuel channel in fluid communication with the chamber, and a valve needle positioned in the chamber and being operable to open and close the opening, said dead spring including a first and second end, and a plurality of coils, wherein at least two of the coils located at one of the ends being at all times at least partially in continuous, intimate contact with each other in its natural state, wherein when said dead spring is positioned in the chamber of the nozzle body and when said spring is in contact with the needle, said dead spring operable to bias the needle to close the opening wherein said at least two coils being in partial continuous, intimate contact are at all times with each other in situ during compression and expansion of said dead spring; wherein fuel is supplied at a select valve opening pressure (VOP) against the force of the dead spring to open the valve needle, and wherein the dead spring is sized and shaped to maintain a valve opening pressure and limit blow back into the fuel channel for achieving desired NOx emissions levels.

19. The spring for the fuel injector assembly according to claim 18 wherein more than one coil in intimate contact with each other at the first end of the spring and more than one coil in intimate contact with each other at the second end of the spring.

20. The spring for the fuel injector assembly according to claim 18 wherein the coils in intimate contact with each other at the first and second ends of the springs is about 1.4 coils.

21. The spring for the fuel injector assembly according to claim 18 wherein the spring is about 24.34 mm in length and has an outer diameter of about 10.37 mm.

22. The spring for the fuel injector assembly according to claim 18 wherein the spring has about 7.9 coils, where the number of active coils is 5.1 and the number of inactive coils at the first and second ends of the spring is about 1.4.

* * * * *